United States Patent [19]

Costa

[11] Patent Number: 4,571,862

[45] Date of Patent: Feb. 25, 1986

[54] ELECTRIC STEAM IRON

[75] Inventor: Giancarlo Costa, Milan, Italy

[73] Assignee: Olimpic Di Costa Lorenzo & C. S.N.C., Milano, Italy

[21] Appl. No.: 654,816

[22] Filed: Sep. 26, 1984

[30] Foreign Application Priority Data

Sep. 28, 1983 [IT] Italy ..... 23096/83[U]

[51] Int. Cl.[4] ..... D06F 75/16

[52] U.S. Cl. ..... 38/77.81; 219/255

[58] Field of Search ..... 38/77.81, 77.7, 77.8; 219/255, 245, 258

[56] References Cited

U.S. PATENT DOCUMENTS

| | | | |
|---|---|---|---|
| 2,240,612 | 5/1941 | Ekstedt | 38/77.81 |
| 2,427,521 | 9/1947 | Butman | 38/77.81 |
| 2,506,950 | 5/1950 | Butman | 38/77.81 |
| 3,184,871 | 5/1965 | D'Alessandro | 38/77.8 |
| 4,196,340 | 4/1980 | Evans, Jr. et al. | 38/77.8 X |

*Primary Examiner*—Werner H. Schroeder
*Assistant Examiner*—Andrew M. Falik
*Attorney, Agent, or Firm*—Karl F. Ross; Herbert Dubno

[57] ABSTRACT

An electric steam iron has a sole plate, a housing carried on the sole plate and defining a substantially closed chamber adapted to hold a body of water, at least one electric heater for heating the water in the chamber to above 100° C., and a valve at the chamber for maintaining the chamber under superatmospheric pressure. Thus superheated steam is produced therein by the heater. A conduit extending between the chamber and the sole plate conducts this superheated steam to the sole plate. The water chamber is above the sole plate and the housing forms another chamber constituting part of the conduit and in turn above the water chamber. The valve is between the chambers and only permits fluid flow into the upper chamber from the water chamber when the pressure in the water chamber is above a predetermined superatmospheric level. The rest of the conduit is formed by a tube that extends vertically through both chambers and has an upper end opening into the upper chamber and a lower end opening downward through the sole plate. The housing has a thin partition wall subdividing the chambers from each other and carrying the valve.

4 Claims, 2 Drawing Figures

19
2
1
S
B
6
5
8
18
4
3
7

21
13
10
9
S'
11
S
B
14
15
17
22
12
20
16

ELECTRIC STEAM IRON

FIELD OF THE INVENTION

The present invention relates to an electric clothes iron. More particularly this invention concerns a steam iron.

BACKGROUND OF THE INVENTION

A steam pressing iron normally has a reservoir for the water that is to be heated to generate the steam, a sole plate, heating elements for heating at least the sole plate, and a passage or conduit system for conducting steam to the bottom surface of the plate. The combination of the steam with the heat from the sole plate is extremely effective in smoothing wrinkles.

Steam is generated in a standard system by dripping the water from the reservoir onto the inner surface of the sole plate, which hotter than 100° C. This water vaporizes instantly and passes out of the iron through holes in the sole plate. Such an arrangement therefore must have its sole plate above 100° C., which is too hot for some delicate synthetic-resin textiles, and can normally only produce a limited volume of steam.

In another arrangement there is a separate heater for vaporizing the water. Such an arrangement can generate a large volume of steam, which is particularly useful in heavy-duty commercial use. In addition it allows the sole plate to be relatively cool, 80° C. to 90°. Nonetheless the equipment is fairly complex and bulky, and is inefficient in that the steam cools some 10° C. in moving to the goods.

OBJECTS OF THE INVENTION

It is therefore an object of the present invention to provide an improved electric steam iron.

Another object is the provision of such an electric steam iron which overcomes the above-given disadvantages, that is which is simple, which can produce large volumes of steam, and which can work as a steam iron while its sole plate is at a relatively low temperature of 50° C. to 90°.

SUMMARY OF THE INVENTION

An electric steam iron according to the invention has a sole plate, a housing carried on the sole plate and defining a substantially closed chamber adapted to hold a body of water, at least one electric heater for heating the water in the chamber to above 100° C., and a valve at the chamber for maintaining the chamber under superatmospheric pressure. Thus superheated steam is produced therein by the heater. A conduit extending between the chamber and the sole plate conducts this superheated steam to the sole plate.

According to further features of this invention the water chamber is above the sole plate and the housing forms another chamber constituting part of the conduit and in turn above the water chamber. The valve is between the chambers and only permits fluid flow into the upper chamber from the water chamber when the pressure in the water chamber is above a predetermined superatmospheric level. The rest of the conduit is formed by a tube that extends vertically through both chambers and has an upper end opening into the upper chamber and a lower end opening downward through the sole plate. The housing has a thin partition wall subdividing the chambers from each other and carrying the valve.

In one arrangement according to the invention the sole plate defines the floor of the water chamber and the heater is carried on the sole plate in the water chamber. It is also possible according to the invention for the housing to include a thin partition above and spaced from the sole plate and defining therewith an insulating space. The partition defines the floor of the water chamber and is traversed by the tube. In this case there are separate and independently controlled electric heaters in the sole plate and in the water chamber.

DESCRIPTION OF THE DRAWING

The above and other features and advantages will become more readily apparent from the following, it being understood that any feature described with reference to only one embodiment of the invention can be used where possible with any other embodiment. In the accompanying drawing.

SPECIFIC DESCRIPTION

Figure 1:
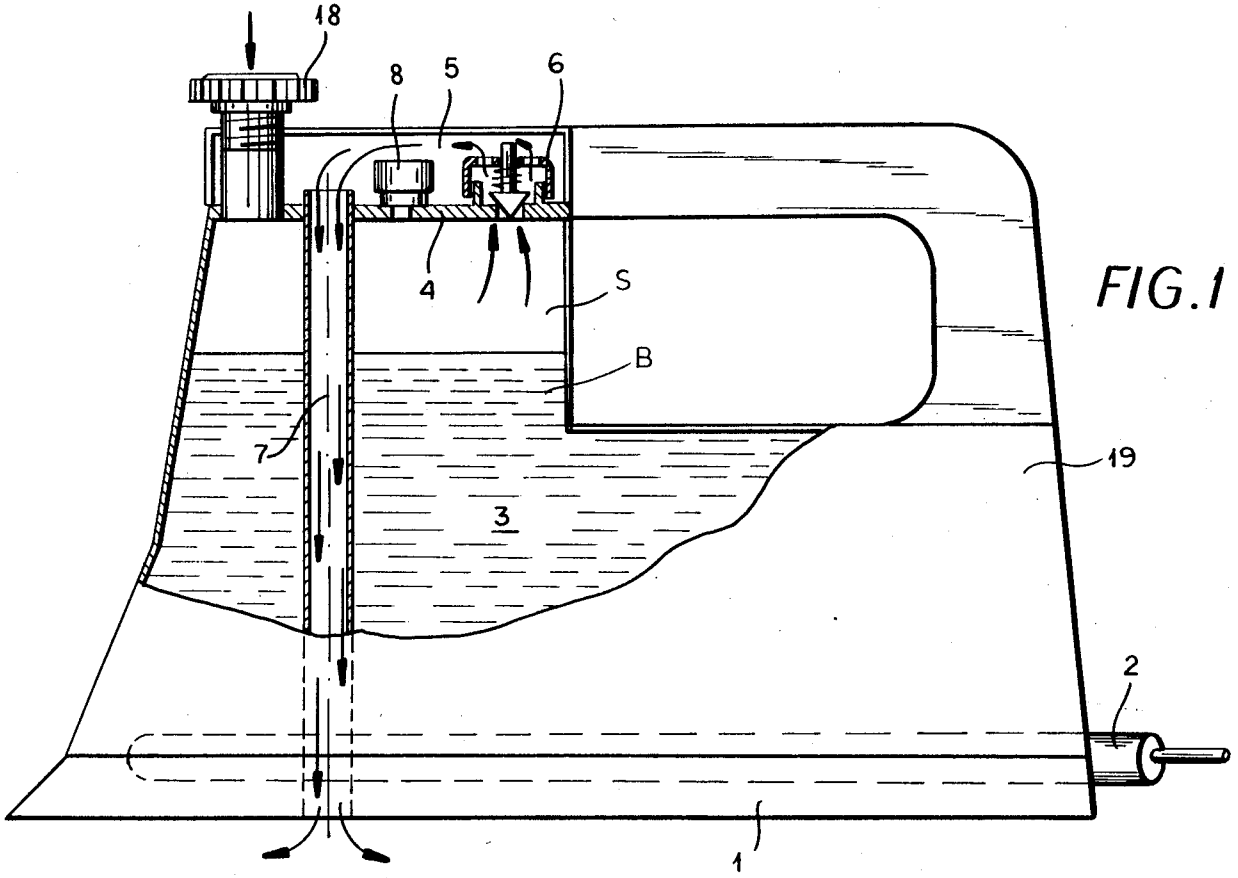
FIG. 1 is a partly sectional side view of the iron according to this invention.

As seen in FIG. 1 an electric clothes iron according to this invention has a housing 19 provided with a standard generally triangular and thick sole plate 1 in which an electrical heating element 2 is at least partially imbedded. A chamber 3 defined by and above this plate 1 and element 2 and below an upper wall 4 is filled with a body B of water above which is an empty space S. This chamber 3 can be filled when a plug 18 at is front end is removed. A tube 7 that is laterally completely closed has a lower end that opens flush with the bottom face of the sole plate 1 and an upper end opening into a chamber 5 defined by the housing 19 above the upper thin partition wall 4 of the chamber 3. This chamber 5 is closed except at the upper end of the tube 7.

A low-pressure relief valve 6 and a high-pressure relief valve 8 are provided in the top wall 4 of the chamber 3, which wall 4 is also the bottom wall of the chamber 5. These two valves 6 and 8 are of similar construction but the latter has a stiffer spring and only serves for emergency blowout in case the valve 6 sticks. They are the only paths out of the chamber 3 when the plug 18 is in place. The chamber 5 is continuously open to the outside through the tube 7.

The heater 2 is of the self-regulating type that when energized is always at a temperature somewhat above 100° C. Thus the water in the chamber 3 will boil, generating steam that will fill the space S and that will only be able to exit from the chamber 3 into the chamber 5 when its pressure is sufficient to open the low-pressure relief valve 6. This superheated steam will completely fill the chamber 5 and pass therefrom down through the tube 7 to exit from the bottom of the iron. The upper part of the tube 7 is as the same temperature as the superheated steam in the space S whereas the bottom part is at the same temperature as the body B of water in the chamber 3, which temperature can be above 100° C. since the chamber 3 is under superatmospheric pressure. As the interior of the tube 7 is virtually under atmospheric pressure, there can be no condensation in it. Overall the steam is produced very efficiently in this arrangement, while at the same time it is deployed without appreciable heat loss.

Figure 2:
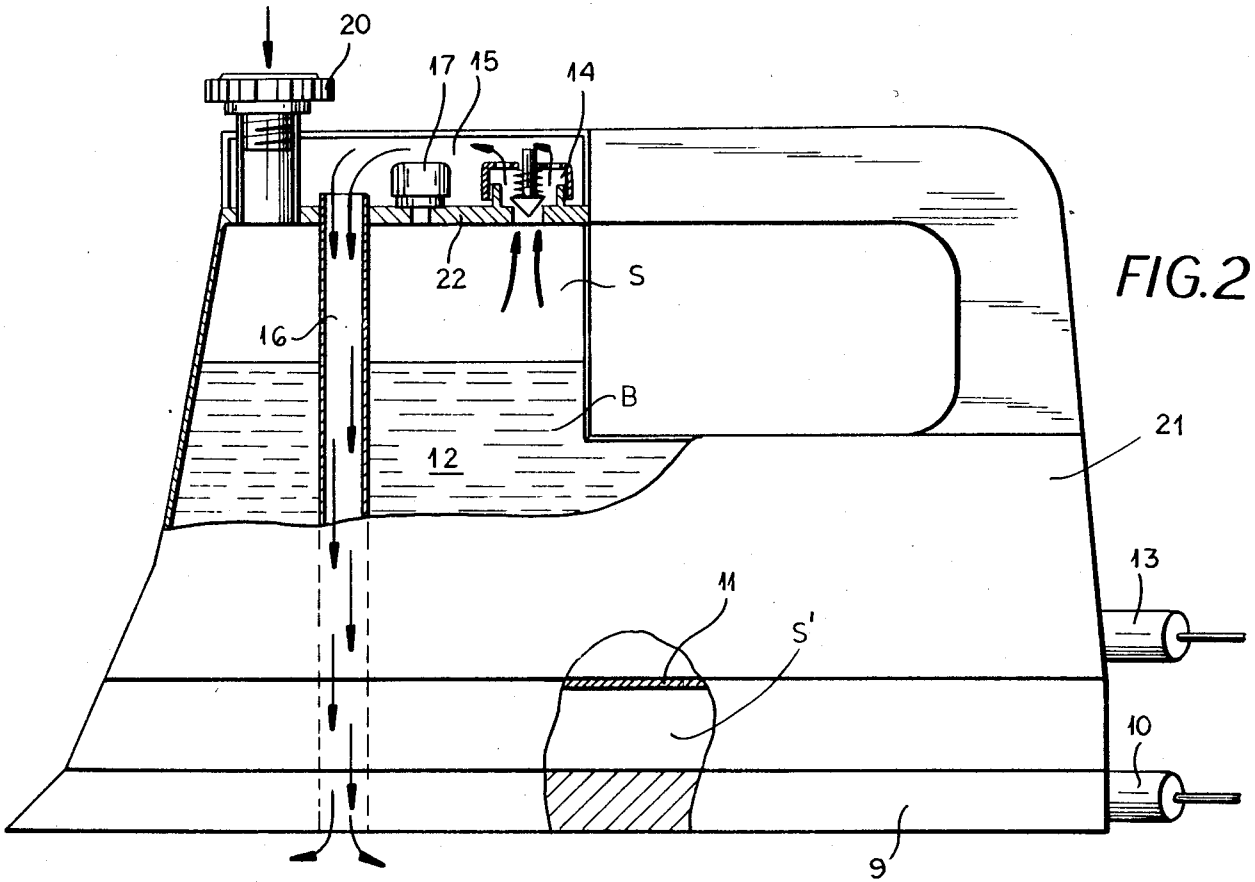
FIG. 2 is a view like FIG. 1 of another iron in accordance with the invention.

The iron of FIG. 2 according to this invention has a housing 21 provided with a standard generally triangular and thick sole plate 9 in which an electrical heating element 10 is imbedded. An intermediate partition 11 spaced in the housing 21 above the plate 9 defines an insulating air-filled compartment or space S' extending over the entire upper surface of this plate 1. A chamber 12 defined by and above this partition 11 and below an upper wall 22 is filled with a body B of water above which is an empty space S. This chamber 12 can be filled when a plug 20 at its front end is removed. A tube 16 that is laterally completely closed has a lower end that opens flush with the bottom face of the sole plate 9 and an upper end opening into a chamber 15 defined by the housing 21 above the upper wall 4 of the chamber 12. This chamber 15 is closed except at the upper end of the tube 16. A separate and independently controlled electric heater capsule 13 is provided in the water chamber 12.

A low-pressure relief valve 14 and a high-pressure relief valve 17 are provided in the top wall 22 of the chamber 12, which wall 22 is also the bottom wall of the chamber 15, these two valves 14 and 17 being functionally identical to the valves 6 and 8 of FIG. 1. The chamber 15 is continuously open to the outside through the tube 16.

The heaters 10 and 13 are independently controlled, although the latter is normally set at a temperature somewhat above 100° C. Thus the water in the chamber 12 will boil, generating steam that will fill the space S and that will only be able to exit from the chamber 12 into the chamber 15 when its pressure is sufficient to open the low-pressure relief valve 14. This superheated steam will completely fill the chamber 15 and pass therefrom down through the tube 16 to exit from the bottom of the iron.

Since the sole plate 9 is independently heated and is separated from the chamber 12 by the insulating space S', the temperature of this plate 9 can be substantially lower than 100° C. An operational range of 80° C. to 90° C. such as needed for delicate fabrics can easily be obtained, while still using superheated steam whose excellent dewrinkling effects are well known.

With either system a great deal of steam can be generated with relatively little waste of heat. The steam is conveyed by an extremely direct route to the point of application.

I claim:

1. An electric steam iron comprising:

a sole plate;

a housing carried on the sole plate and defining a substantially closed chamber adapted to hold a body of water;

means for heating the water in the chamber to above 100° C.;

means including a valve at the chamber for maintaining the chamber under superatmospheric pressure, whereby superheated steam is produced therein by the heating means;

a conduit extending between the chamber and the sole plate for conducting this superheated steam to the sole plate, the water chamber being above the sole plate and the housing forms another chamber constituting part of the conduit and in turn above the water chamber, the valve being between the chambers and only permitting fluid flow into the upper chamber from the water chamber when the pressure in the water chamber is above a predetermined superatmospheric level, the rest of the conduit being formed by a tube that extends vertically through both chambers and has an upper and opening into the upper chamber and a lower end opening downward through the sole plate.

2. The electric steam iron defined in claim 1 wherein the housing has a thin partition wall subdividing the chambers from each other.

3. The electric steam iron defined in claim 1 wherein the sole plate defines the floor of the water chamber and the heating means includes an electric heater carried on the sole plate in the water chamber.

4. The electric steam iron defined in claim 1 wherein the housing includes a partition above and spaced from the sole plate and defining therewith an insulating space, the partition defining the floor of the water chamber, the tube traversing the partition and space also, the heating means being separate and independently controlled electric heaters in the sole plate and in the water chamber.

* * * * *